United States Patent [19]

Kimoto et al.

[11] 4,324,598

[45] Apr. 13, 1982

[54] FINISH ANNEALING PROCESS FOR GRAIN-ORIENTED ELECTRICAL STEEL STRIP OR SHEET

[75] Inventors: Tetsuo Kimoto; Hisao Takahashi; Hiromichi Koshiishi; Yasuhiro Shinkai, all of Kitakyushu; Toshimi Kawabata, Fukuoka, all of Japan

[73] Assignee: Nippon Steel Corporation, Tokyo, Japan

[21] Appl. No.: 209,300

[22] Filed: Nov. 21, 1980

[30] Foreign Application Priority Data

Dec. 7, 1979 [JP] Japan ..... 54/157996

[51] Int. Cl.[3] ..... H01F 1/04

[52] U.S. Cl. ..... 148/111; 148/31.5

[58] Field of Search ..... 148/110, 111, 112, 113, 148/31.5, 27, 28; 427/127

[56] References Cited

U.S. PATENT DOCUMENTS

| | | | |
|---|---|---|---|
| 2,906,645 | 9/1959 | Carpenter et al. | 148/113 |
| 3,152,930 | 10/1964 | Foster | 148/113 |
| 3,634,148 | 1/1972 | Shin et al. | 148/111 |
| 3,640,780 | 2/1972 | Stanley | 148/111 |
| 3,785,882 | 1/1974 | Jackson | 148/112 |
| 4,160,705 | 7/1979 | Arendt et al. | 148/113 |
| 4,177,092 | 12/1979 | Thursby | 148/113 |

OTHER PUBLICATIONS

*The Making, Shaping and Treating of Steel,* United States Steel, 7th ed. 1957 pp 412–419.

*Primary Examiner*—L. Dewayne Rutledge
*Assistant Examiner*—John P. Sheehan
*Attorney, Agent, or Firm*—Wenderoth, Lind & Ponack

[57] ABSTRACT

In finish annealing process for a grain-oriented electrical steel strip or sheet, an improvement is disclosed which comprises coating the grain-oriented electrical steel strip or sheet with an annealing separator having a water content adjusted to not more than 10%, drying the coated strip or sheet, forming it into a strip coil, and finish annealing the strip coil within the inner cover of an annealing furnace while controlling the pressure of the gas atmosphere within the inner cover.

8 Claims, 2 Drawing Figures

FINISH ANNEALING PROCESS FOR GRAIN-ORIENTED ELECTRICAL STEEL STRIP OR SHEET

BACKGROUND OF THE INVENTION

A. Field of the Invention

The present invention relates to a finish annealing process for a grain-oriented electrical strip or sheet, and more particularly to a finish annealing process for annealing a grain-oriented electrical strip or sheet in coiled form by means of box annealing using combustion heat obtained from a combustible gas and/or a combustible gas containing liquid fuel.

B. Description of the Prior Art

In the production of a grain-oriented electrical strip or sheet, it is known to subject a hot rolled steel strip adjusted to contain not more than 0.085% C and 2.0–4.0% Si to at least one cold rolling operation combined with heat treatment, to decarburizing annealing, to coating with an annealing separator such as magnesia slurry, to drying, and then to finish annealing in coiled from in a high purity reducing atmosphere at a high temperature for an extended period of time. In the above finish annealing process at high temperature, it is very important for the grain-oriented electrical steel strip to form a coating film having superior properties in connection with electrical insulation, space factor and the like.

It is required for the coating film of the grain-oriented electrical steel strip to have high electric insulation, strong adhesion to the matrix, a high space factor, high heat resistance, uniform properties and uniform appearance.

As is well known, the coating film is formed on the grain-oriented electrical steel strip in the high-temperature finish annealing process as follows: a substance consisting solely or mainly of MgO is suspended in water to form a MgO slurry, the slurry is applied as an annealing separator to the surface of the steel strip which has been subjected to decarburizing annealing, the slurry is dried, and the steel strip is thereafter coiled. Subsequently, the steel strip coil is subjected to the high-temperature finish annealing process.

The annealing separator applied to and dried on the steel strip contains water in the form of free water, $H_2O$, and water of crystallization, $Mg(OH)_2$. Expressed in terms of water content, that is in terms of percentage by weight of the total free water and water of crystallization, the water content will usually amount to 10% and more and in extreme cases may exceed 20%. This water is soon evaporated as the temperature rises in the high-temperature finish annealing step.

However, since the steel strip coil is subjected to box annealing, the temperature varies from place to place within the coil and as a result, the rate of water evaporation also differs from place to place. This causes an oxidizing atmosphere to form locally at certain places between overlapped portions of the coil. On the other hand, in the region of the high-temperature finish annealing above the temperature of 950° C., the steel reacts with the magnesia of the annealing separator to gradually form a surface film of the $MgO\text{-}SiO_2$ system, for instance forsterite ($Mg_2SiO_2$).

In the gradual formation of forsterite in the above process, particular attention should be paid to preventing pockets of oxidizing atmosphere from being present between overlapped portions of the coil. If an excessively oxidizing atmosphere is present in the spaces between the overlapped portions of the coil, the steel at the surface of the matrix will be oxidized to such an extent that the formation of forsterite ($Mg_2SiO_2$) is inhibited. As a result, the film formed during the high temperature finish annealing process will contain much ferrous oxide, which is low in electric insulation.

In order to prevent such defect, an electric furnace equipped with an electric heater has heretofore been used for carrying out the high-temperature finish annealing process. By using an electric furnace, the retained water of the strip coil can be evaporated at the initial stage of the high-temperature finish annealing, stepwise heating including gradual heating and/or low temperature soaking can be easily carried out, and, furthermore, uniform distribution of the temperature within the furnace can be attained so as to minimize the unevenness in temperature.

When the high temperature finish annealing process is conducted in an electric furnace, a surface film with excellent properties can be obtained, but, on the other hand, the energy cost for the electric annealing operation is exorbitant.

In order to overcome the high cost energy problem, consideration might be given to a gas-fired annealing furnace fueled by a combustible gas such as is used for the annealing of low carbon steel strip coils. However, in the case where the high-temperature finish annealing process is carried out in the conventional gas-fired annealing furnace, it is not possible to form a good surface film on the grain-oriented electrical steel. What would be obtained would be a film having inferior magnetic properties degraded by a synergetic effect brought about by the fact that the annealing separator of the grain-oriented electrical steel contains water which evaporates as described earlier and the fact that there is considerable local variation in temperature within the gas-fired furnace.

In addition, in the gas-fired annealing equipment of the prior art, $CO_2$ gas from the burning of the combustible gas tends to find its way into the hydrogen gas within the inner cover of the annealing furnace. If this $CO_2$ gas should penetrate to within the inner cover, the magnetic properties of the grain-oriented electrical steel will be degraded. Therefore, the gas-fired annealing furnace has never been used for the finish annealing process of grain-oriented electrical steel in spite of its economical advantage from the viewpoint of energy costs.

SUMMARY OF THE INVENTION

Accordingly, it is an object of the present invention to provide a finish annealing process for a grain-oriented electrical steel strip or sheet having superior film and magnetic properties by taking into consideration the relationship between the water content of the annealing separator and the properties of the coating film of the grain-oriented electrical steel strip or sheet.

It is another object of the invention to provide a finish annealing process for grain-oriented electrical strip or sheet material wherein the finish heat treatment is conducted by the heat of combustion of a combustible gas and/or a combustible gas containing liquid fuel without lowering the purity of the gas atmosphere.

It is an additional object of the invention to provide a novel process for finish annealing a grain-oriented electrical steel strip or sheet within the inner cover of an annealing furnace wherein the pressure of the gas atmosphere is maintained within a specified range.

BRIEF EXPLANATION OF THE DRAWINGS

Other and further objects of the invention will be better understood from the following detailed description with reference to the accompanying drawings, in which.

DETAILED DESCRIPTION OF THE INVENTION

In the finish annealing process for a steel strip coil to be annealed, the strip coil is first coated with a known annealing separator. Through extensive experiments, the inventors have learned that the water content of the annealing separator exerts a much greater influence on the film properties of the coil to be annealed when it is subjected to high-temperature finish annealing in a gas-fired annealing furnace than when it is subjected to such annealing process in the electric furnace of the prior art.

It has been found that when a conventional annealing separator containing more than 10% water is applied, the coating film formed is inferior in electric insulation, space factor, adhesion and appearance, and further, a deterioration of the magnetic properties of the grain-oriented electrical steel also results.

Having investigated the above problem on the deterioration of the film properites in detail with a view to overcoming it, the inventors have found that it is exceedingly important that the water content of the annealing separator should be reduced to not more than 10%, preferably to less than 7% by using an annealing separator of low activity which hardly reacts with water. It has been found that the application of an annealing separator which meets the above requirements results in the formation of a surface film having excellent properties and has no deteriorating effect on the magnetic properties of the grain-oriented steel.

The reason why the upper limit of the water content has been set at 10% lies in the fact that, if it exceeds 10%, the coating film thus obtained is of low quality because the amount of water introduced into the high-temperature finish annealing process becomes excessive.

As described above, the grain-oreinted electrical steel strip coil coated with an annealing separator whose water content is maintained at less than 10% is subjected to the high-temperature finish annealing in a gas-fired annealing furnace, and further, in order to prevent the penetration of $CO_2$ gas to within the inner cover of the annealing furnace, the pressure of the gas atmosphere within the inner cover is maintained to be higher than that outside the inner cover. The difference between the inner and outer gas pressures is preferably not less than 5 mm water column.

Figure 1:
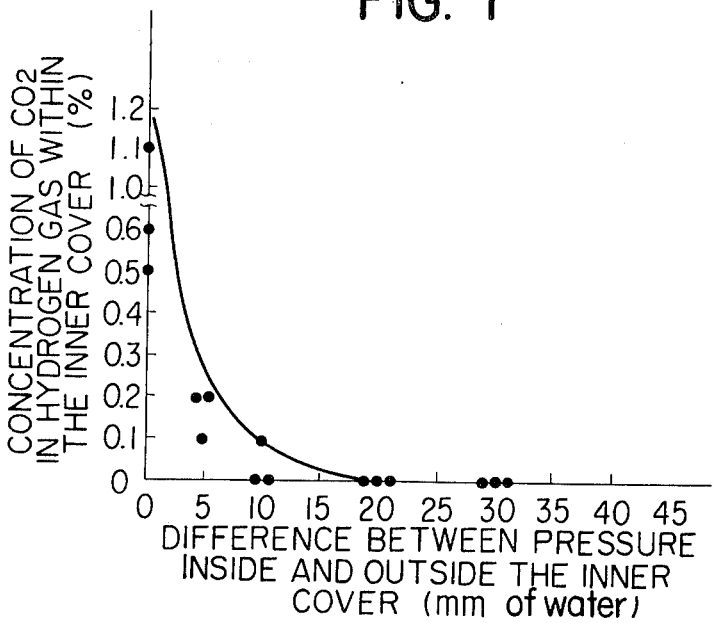
FIG. 1 is a graph showing the relationship between the concentration of $CO_2$ in the hydrogen gas within the inner cover and the difference in pressure inside and outside the inner cover of the annealing furnace.

The reason for this will be understood from FIG. 1 which shows the relationship between the concentration of $CO_2$ gas in the hydrogen gas inside the inner cover and the difference of gas pressure shown in millimeters of water (gas pressure inside the inner cover minus gas pressure outside the inner cover).

The experiments on which this graph is based were carried out without packing a powder seal material into the airtight groove of the inner cover as will be described later, and further, without supplying gas into the airtight chamber in the manner to be explained later.

As is clear from FIG. 1, a critical point is seen in the vicinity of a difference of gas pressures of 5 millimeters of water. Accordingly, in the present invention, for the purpose of preventing the penetration of $CO_2$ gas to within the inner cover, it is required that the gas pressure inside the inner cover should be at least 5 millimeters of water higher than that outside the inner cover.

Now, the present invention will be described in more detail with reference to the accompanying drawings.

Figure 2:
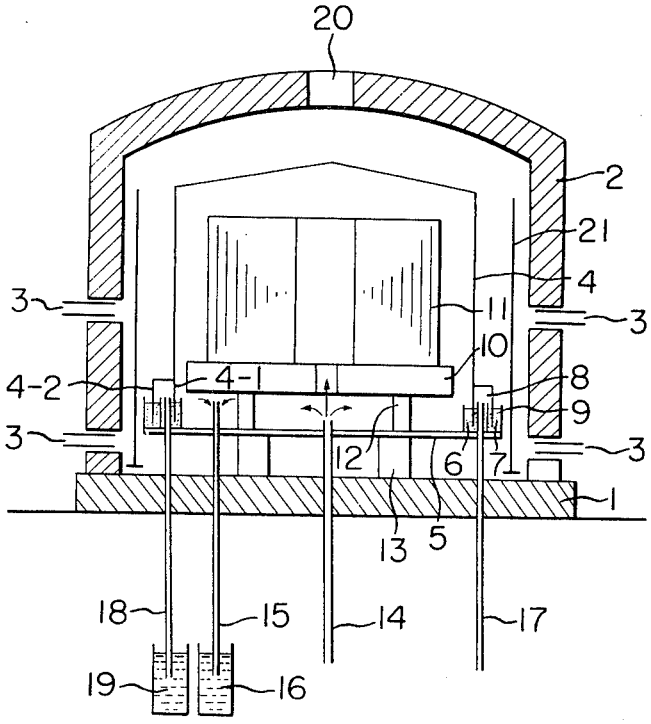
FIG. 2 is an explanatory sectional view of the annealing furnace for carrying out the process of the present invention in accordance with the principle of the invention.

FIG. 2 shows an annealing furnace pedestal 1 supporting a furnace body 2, the sides of which are provided with a plurality of spaced burners 3 for burning a combustible gas and/or a combustible gas containing liquid fuel. An inner cover 4 has legs 4-1 and 4-2 which are inserted respectively into an inner airtight groove 6 and an outer airtight groove 7 provided on a support plate 5.

The space enclosed by the legs 4-1, 4-2, the inner airtight groove 6 and the outer airtight groove 7 constitutes an airtight chamber 8. A heat resistant powder sealing material 9, such as white siliceous sand, is packed into the grooves 6 and 7.

The grain-oriented electrical steel strip or sheet to be treated is coated with the annealing separator, dried, and rolled into a coil 11 which is placed on a base plate 10. The base plate 10 is supported on a support ring 12 and the support plate 5 is supported on a support ring 13. An atmosphere gas, such as high purity hydrogen gas, is supplied via a feed pipe 14 to within the inner cover 4. An exhaust stack 15 for the atmosphere gas is also provided. The lower end outlet of the exhaust stack 15 communicates with a gas pressure control apparatus 16.

The annealing furnace further comprises a gas feed pipe 17 for feeding gas into the airtight chamber 8, an exhaust pipe 18 for removing gas from the airtight chamber 8, a gas pressure control apparatus 19 for controlling the pressure of the gas in the airtight chamber 8, an exhaust outlet 20 for exhausting combusted gas, and a cylindrical wall plate 21 for preventing unevenness in heat distribution.

The high temperature finish annealing process in accordance with the present invention will now be described in detail.

A steel strip coil 11 to be annealed is placed on the base plate 10 inside the inner cover 4. The gas pressure inside the inner cover 4 is kept at a specified value which is higher than that outside the inner cover 4. This pressure relationship can be maintained since, as described above, both the inner airtight groove 6 and the outer airtight groove 7 are filled with the sealing material 9, the airtight chamber 8 is formed by providing the inner cover 4 with a second leg 4-2, and the airtight chamber is provided with the gas pressure control apparatus 19. The difference in the gas pressure inside and outside the inner cover 4 is preferably 5 millimeters of water or greater.

Thus, the invasion of the combusted gas from the burners 3 to within the inner cover 4 can be prevented.

In order to more completely prevent the combusted gas from the burners 3 from making its way to within the inner cover 4, high purity hydrogen gas is also preferably supplied into the airtight chamber 8. In this case, the gas pressure in the airtight chamber 8 is preferably kept somewhat lower than that of the atmosphere gas within the inner cover 4.

Subsequently, a combustible gas such as CO gas or LPG is introduced through the burners and caused to burn in the space outside of the inner cover 4 so that the coil 11 to be annealed is heated by the combustion heat in accordance with a predetermined finish annealing cycle.

In carrying out the annealing by the combustion of a combustible gas in accordance with this invention, the combusted gas cannot penetrate to within the inner cover 4 because of the novel construction of the annealing furnace wherein the leg 4-1 and the second leg 4-2 of the inner cover 4 are inserted into the inner airtight groove 6 and the outer airtight groove 7, both of which are filled with the heat resistance powder sealing material described above so as to form the airtight chamber 8. As a result, the purity of the atmosphere gas is assured. Accordingly, impurities such as C, N, S etc. contained in the coil are so reduced that a grain-oriented electrical steel having superior magnetic properties can be produced.

Moreover, more complete prevention of the invasion of combusted gas to within the inner cover 4 can be accomplished by supplying the same high purity hydrogen gas as that of the atmosphere gas into airtight chamber 8 and keeping the gas pressure in the airtight chamber 8 lower than of the atmosphere within the inner cover 4.

Since the cylindrical wall plate 21 is provided between the burners 3 and the inner cover 4 to prevent uneven heat distribution, there is no concentration of the flame from the burners 3 on particular areas of the inner cover 4 so that combustion damage of the inner cover 4 can be obviated and, at the same time, more effective uniform heating of the coil 11 to be annealed can be attained. Because of this uniform heating, the film properties of the coil 11 thus annealed are not deteriorated but are completely the same as those of a coil heat treated by an electric heater.

EXAMPLE 1

Three coils of grain-oriented electrical steel containing 2.9% Si were coated with the same annealing separator (in this Example, magnesia) except that the water content of the annealing separator was varied from coil to coil. They were then dried and subjected to high-temperature finish annealing in the gas-fired annealing furnace shown in FIG. 2.

The three coils of 0.30 mm grain-oriented electrical steel to be annealed were subjected to continuous decarburizing annealing and then each was coated with the magnesia slurry of a different water content. The three coils were then subjected to the high temperature finish annealing of this invention.

Case 1: Coil coated with magnesia slurry wih 13.6% water content.

Case 2: Coil coated with magnesia slurry with 9.4% water content.

Case 3: Coil coated with magnesia slurry with 6.8% water content.

Annealing heat cycle:

Temperature raised from room temperature to 700° C. over 5 hours.

Soaking at 700° C. for 10 hours.

Temperature raised from 700° C. to 1200° C. over 25 hours.

Soaking at 1200° C. for 20 hours.

Cooling from 1200° C. to 600° C. over 40 hours followed by air-cooling.

The atmosphere gas of the annealing furnace was high purity hydrogen. Other operational conditions of the annealing furnace were as follows:

Inner airtight groove: filled with white siliceous sand, 0.1–0.6 mm grain size (99% $SiO_2$).

Outer airtight groove: filled with white siliceous sand, 0.1–0.6 mm grain size (99% $SiO_2$).

Feed gas into the airtight chamber: hydrogen gas; pressure in airtight chamber kept at 40 millimeters of water.

Pressure of gas atmosphere within the inner cover: 40 millimeters of water.

Pressure of combusted gas outside the inner cover: 0–5 millimeters of water.

TABLE 1

| | Water Content of coil to be treated (%) | Sampling Location of Coil to be treated | Film Properties: Electric Insulation ($\Omega$-cm$^2$/sheet) | Film Properties: Space Factor (%) | Impurities remaining in the steel: C (%) | N (%) | S (%) | Magnetic Properties: Magnetic Flux Density $B_{10}$ (Wb/m$^2$) | Iron Loss $W_{17/50}$ (W/Kg) |
|---|---|---|---|---|---|---|---|---|---|
| Case 1 (Control) | 13.6 | Outer Circumference of Coil | 0.49–1.93 | 98.4 | 0.0016 | 0.0014 | 0.0012 | 1.92 | 1.12 |
| | | Center of Coil Inner Circumference of Coil | 0.13–0.88 | 98.1 | 0.0021 | 0.0015 | 0.0013 | 1.93 | 1.09 |
| | | Inner Circumference of Coil | 0.13–1.42 | 98.3 | 0.0017 | 0.0017 | 0.0010 | 1.93 | 1.11 |
| Case 2 (This Invention) | 9.4 | Outer Circumference of Coil | 0.49–5.28 | 98.8 | 0.0018 | 0.0013 | 0.0009 | 1.93 | 1.09 |
| | | Center of Coil | 0.49–1.93 | 99.0 | 0.0016 | 0.0014 | 0.0013 | 1.93 | 1.08 |
| | | Inner Circumference of Coil | 0.80–3.32 | 98.7 | 0.0019 | 0.0016 | 0.0012 | 1.94 | 1.08 |
| Case 3 (This | 6.8 | Outer Circumference of | 0.96–4.67 | 99.1 | 0.0015 | 0.0012 | 0.0011 | 1.94 | 1.06 |

TABLE 1-continued

| | Water Content of coil to be treated (%) | Sampling Location of Coil to be treated | Film Properties: Electric Insulation (Ω-cm²/sheet) | Film Properties: Space Factor (%) | Impurities remaining in the steel: C (%) | N (%) | S (%) | Magnetic Properties: Magnetic Flux Density $B_{10}$ (Wb/m²) | Iron Loss $W_{17/50}$ (W/Kg) |
|---|---|---|---|---|---|---|---|---|---|
| Invention) | | Coil Center of Coil | 0.49–6.45 | 98.9 | 0.0018 | 0.0012 | 0.0012 | 1.94 | 1.05 |
| | | Inner Circumference of Coil | 0.80–3.32 | 99.0 | 0.0017 | 0.0014 | 0.0010 | 1.93 | 1.07 |

EXAMPLE 2

Three coils of grain-oriented electrical steel containing 0.04% C, 2.9% Si, 0.08% Mn, and 0.03% sol.Al were subjected to finish annealing using CO gas according to the heat cycle shown below but under varying airtight conditions and varying gas pressures as shown in Table 2. The results are summarized in Table 3.

TABLE 2

| Airtight Condition | Case 4 (Control) | Case 5 (This invention) | Case 6 (This invention) |
|---|---|---|---|
| Material packed in inner airtight groove | none | White siliceous sand | White siliceous sand |
| Material packed in outer airtight groove | none | White siliceous sand | White siliceous sand |
| Gas supply to airtight chamber | none | none | Hydrogen gas at pressure of 35 mm Aq |
| Gas pressure within the inner cover | 20 mm of water | 20 mm of water | 40 mm of water |
| Gas pressure outside the inner cover | 0–15 mm of water | 0–15 mm of water | 0–15 mm of water |

High purity hydrogen gas was used as the atmosphere gas.

Annealing heat cycle:

Temperature raised from room temperature to 700° C. over 5 hours.

Soaking at 700° C. for 10 hours.

Temperature raised from 700° C. to 1200° C. over 25 hours.

Soaking at 1200° C. for 20 hours.

Cooling from 1200° C. to 600° C. over 40 hours followed by air cooling.

TABLE 3

| Case | Sampling Location of the Coil to be treated | Impurities Remaining in the Steel: C (%) | N (%) | S (%) | Magnetic Properties: Magnetic Flux Density $B_{10}$ (Wb/m²) | Iron Loss $W_{17/50}$ (W/Kg) |
|---|---|---|---|---|---|---|
| 4 | Outer Circumference of Coil | 0.0016 | 0.0018 | 0.0013 | 1.93 | 1.10 |
| | Center of Coil | 0.0014 | 0.0021 | 0.0011 | 1.94 | 1.09 |
| | Inner Circumference of Coil | 0.0018 | 0.0016 | 0.0014 | 1.94 | 1.09 |
| 5 | Outer Circumference of Coil | 0.0015 | 0.0010 | 0.0012 | 1.94 | 1.06 |
| | Center of Coil | 0.0019 | 0.0013 | 0.0014 | 1.94 | 1.05 |
| | Inner Circumference of Coil | 0.0016 | 0.0011 | 0.0014 | 1.94 | 1.05 |
| 6 | Outer Circumference of Coil | 0.0014 | 0.0012 | 0.0013 | 1.94 | 1.05 |
| | Center of Coil | 0.0017 | 0.0011 | 0.0014 | 1.95 | 1.04 |
| | Inner Circumference of Coil | 0.0015 | 0.0013 | 0.0011 | 1.94 | 1.06 |

As clearly shown in Table 1, the high-temperature annealed coils of cases 2 and 3 in accordance with the present invention excelled over that of case 1 in electric insulation, space factor and film properties. Furthermore, as clearly indicated in Table 3, the magnetic properties of the high-temperature annealed coils of case 5 (present invention) in which the heat resistant powder sealing material 9 was packed into the outer airtight groove 7 and of case 6 (present invention) in which the airtight chamber 8 was supplied with gas were considerably improved over those of case 4 (control) because of a greater reduction of impurity (N content in these cases).

As the invention utilizes gas heating, the energy cost required for the finish annealing process was decreased by about 40% as compared with that of electric heating.

As fully explained in the foregoing, in the finish annealing process for grain-oriented electrical steel in accordance with the present invention, heating is carried out using the combustion heat of a combustible gas at a low energy cost, and the purity of the atmosphere gas can be maintained without contamination by the combusted gas so that the impurities contained in the steel are removed to such an extent that a grain-oriented electrical steel sheet material having superior magnetic properties can be produced.

We claim:

1. In a process for finish annealing a grain-oriented electrical steel strip containing 2.0 to 4.0% Si in the form of a strip which has been subjected to a conventional series of operations including hot rolling, cold rolling and annealing, the improvement comprising:

coating said steel strip with an annealing separator having a water content of not more than 10%;

drying said coating on said strip;

forming said strip coated with said annealing separator into a coil;

positioning said coil within an inner cover of a combustion annealing furnace;

supplying an atmosphere gas into the interior of said inner cover and maintaining the pressure of said atmosphere gas within said inner cover at least 5 mm of water higher than the gas pressure exterior of said inner cover; and carrying out combustion exterior of said inner cover and subjecting said inner cover, said interior of said inner cover and said coil within said inner cover to the heat of said combustion, and thereby finish annealing said coil, while preventing combustion gases resulting from said combustion from entering into said interior of said inner cover.

2. The improvement claimed in claim 1, wherein said combustion annealing furnace includes a furnace body surrounding said inner cover, said body having therein at least one gas burner, and said carrying out said combustion comprises firing said at least one gas burner and uniformly directing said heat of combustion toward the exterior of said inner cover, and thereby uniformly heating said coil within said interior of said inner cover.

3. The improvement claimed in claim 2, wherein said step of uniformly directing said heat of combustion comprises providing an annular wall plate between said inner cover and said at least one burner, and directing said heat of combustion against said wall plate, thereby preventing concentration of said heat of combustion on any particular area of said exterior of said inner cover.

4. The improvement claimed in claim 1, wherein said annealing separator has a water content of less than 7%.

5. The improvement claimed in claim 1, wherein said atmosphere gas comprises high purity hydrogen.

6. The improvement claimed in claim 1, wherein said inner cover has a pair of spaced annular legs, and further comprising sealing lower ends of said legs, thereby defining a gas tight annular chamber, and supplying a gas into said annular chamber and maintaining said gas in said annular chamber at a pressure less than said pressure of said atmosphere gas within said inner cover.

7. The improvement claimed in claim 6, wherein said gas supplied to said annular chamber comprises high purity hydrogen.

8. The improvement claimed in claim 6, comprising maintaining said pressure of said gas in said annular chamber greater than said gas pressure exterior of said inner cover.

* * * * *